US009068420B2

(12) United States Patent
Rajabi et al.

(10) Patent No.: US 9,068,420 B2
(45) Date of Patent: Jun. 30, 2015

(54) DEVICE AND METHOD FOR CONTROLLING RETURN FLOW FROM A BORE HOLE

(71) Applicant: AGR SUBSEA AS, Straume (NO)

(72) Inventors: Mehdi Mir Rajabi, Aberdeen (GB); Roger Sverre Stave, Bergen (NO)

(73) Assignee: AGR SUBSEA AS, Straume (NO)

( * ) Notice: Subject to any disclaimer, the term of this patent is extended or adjusted under 35 U.S.C. 154(b) by 0 days.

(21) Appl. No.: 14/350,720

(22) PCT Filed: Sep. 27, 2012

(86) PCT No.: PCT/NO2012/050187

§ 371 (c)(1),
(2) Date: Apr. 9, 2014

(87) PCT Pub. No.: WO2013/055226

PCT Pub. Date: Apr. 18, 2013

(65) Prior Publication Data

US 2014/0251693 A1 Sep. 11, 2014

Related U.S. Application Data

(60) Provisional application No. 61/545,745, filed on Oct. 11, 2011.

(51) Int. Cl.

| | |
|---|---|
| ***E21B 7/12*** | (2006.01) |
| ***E21B 21/00*** | (2006.01) |
| ***E21B 21/08*** | (2006.01) |

(52) U.S. Cl.

CPC . *E21B 21/08* (2013.01); *E21B 7/12* (2013.01); *E21B 21/001* (2013.01)

(58) Field of Classification Search

CPC ..... E21B 7/12; E21B 19/004; E21B 21/001
USPC ..... 175/66, 5, 207, 217; 166/347, 358, 367, 166/241.6; 405/224.2

See application file for complete search history.

(56) References Cited

U.S. PATENT DOCUMENTS

| | | | | |
|---|---|---|---|---|
| 4,466,487 | A * | 8/1984 | Taylor, Jr. | 166/339 |
| 7,165,610 | B2 * | 1/2007 | Hopper | 166/84.4 |
| 7,270,185 | B2 * | 9/2007 | Fontana et al. | 166/358 |
| 7,497,266 | B2 * | 3/2009 | Fossli | 166/358 |
| 2001/0050185 | A1 * | 12/2001 | Calder et al. | 175/5 |
| 2004/0069504 | A1 | 4/2004 | Krueger et al. | |
| 2008/0190663 | A1 * | 8/2008 | Stave | 175/7 |
| 2010/0175882 | A1 * | 7/2010 | Bailey et al. | 166/335 |
| 2011/0278014 | A1 * | 11/2011 | Hughes et al. | 166/367 |
| 2011/0315404 | A1 | 12/2011 | Bailey et al. | |
| 2013/0175044 | A1 * | 7/2013 | Telfer | 166/358 |

* cited by examiner

*Primary Examiner* — Matthew Buck
(74) *Attorney, Agent, or Firm* — Foley & Lardner LLP

(57) ABSTRACT

There is provided a device and method for control of return flow from a borehole (18) where drill fluid is supplied from a surface rig (16) via a multi section drill string (4) to a bottom hole assembly (18), the drill pipe sections (6) having tool joints (8) that include an enlarged outer diameter portion (9), and where an annulus (12) is formed between a pipe (2) and the drill string (4), and where the annulus (12) is in fluid communication with or forms part of a return path (40) for the drill fluid, and where a choke (1) is positioned in the annulus (12), and where the length (L) of the choke (1) exceeds the distance (M) between the enlarged outer diameter portion (9) of two adjacent tool joints (8).

21 Claims, 5 Drawing Sheets

DEVICE AND METHOD FOR CONTROLLING RETURN FLOW FROM A BORE HOLE

There is provided a method for controlling return flow from a borehole. More precisely there is provided a device for control of return flow from a borehole where drill fluid is supplied from a surface rig via a multi section drill string to a bottom hole assembly, the drill pipe sections having tool joints that include an enlarged outer diameter portion, and where an annulus is formed between a pipe and the drill string, and where the annulus is in fluid communication with or forms part of a return path for the drill fluid, and where a choke is positioned in the annulus. There is also provided a method for controlling the return flow from a bore hole.

When drilling sub sea wells, typically in connection with petroleum exploration, problems of keeping a desired pressure in the well and related gas inflow are commonly encountered.

Drill fluid is pumped from a surface rig through the drill pipe to the drill bit at the bottom hole assembly. From the drill bit the drill fluid returns to the surface rig via the wellbore annulus and a riser, carrying drill cuttings with it.

As flow friction is present at drill fluid circulation, the bottom hole pressure is different at drill fluid circulation and at none circulation. The flow friction is dependent on properties such as fluid density, viscosity and content of cuttings. The flow friction is together with the drill fluid density included in a commonly used term: "Equivalent circulating density" (ECD) that is closely related to the bottom hole pressure.

At the bottom of a sub sea well the allowable pressure band is usually limited by a lower pressure when formation fluid will flow into the well, and an upper limit when the pressure may lead to fracture of the well formation. This pressure band is often comparatively narrow. In some cases the flow friction may cause the bottom hole pressure to exceed the allowable pressure band. If this is the case and the drill fluid density is adjusted to just keep the well stable at non-circulating situations, fracture of the well formation may occur at circulation of drill fluid.

Further adjustment of the drill fluid density may partly remedy the problem, but may among other negative effects result in insufficient transport of drill cuttings to the surface.

The traditional way of overcoming the pressure problem has been to insert new casing pipes at relatively short intervals during drilling. Other methods include assisted transport of return drill fluid for instance by use of a pump, and so-called dual gradient drilling.

U.S. Pat. No. 7,270,185 discloses a drilling system that is designed to remedy some of the above mentioned problems by use of a relatively complicated choke system.

The purpose of the invention is to overcome or reduce at least one of the disadvantages of the prior art.

The purpose is achieved according to the invention by the features as disclosed in the description below and in the following patent claims.

There is provided a device for control of return flow from a borehole where drill fluid is supplied from a surface rig via a multi section drill string to a bottom hole assembly, the drill pipe sections having tool joints that include an enlarged outer diameter portion, and where an annulus is formed between a pipe and the drill string, and where the annulus is in fluid communication with or forms part of a return path for the drill fluid, and where a choke is positioned in the annulus, and where the length of the choke exceeds the distance between the enlarged outer diameter portions of two adjacent tool joints.

The surface rig may be a vessel of any suitable kind or a fixed installation. The drill string is built up from drill pipe sections. The outer diameter portion of the tool joints is said to be enlarged compared to the outer diameter of the drill pipe sections extending between the tool joints.

Normally, the choke has a bore of constant diameter. Due to the length of the choke, at least one tool joint will at any time, at least partly, be positioned in the choke.

A first opening, normally annulus formed, may be present between the enlarged outer diameter portion of the tool joint and the choke. The tool joint will not fully seal against the choke, but provide a clearance for movement of the tool joint and thus the drill string inside the choke. The clearance in the first opening will however provide a significant restriction to flow.

It has been found that the width in radial direction of the first opening should not be less than 0.5 mm in order to allow for unrestricted movement of the tool joints. The width should not be more than 12 mm in order to provide for a satisfactory choking function. A first opening width of between 1.5 and 3 mm is preferable.

In some cases it is advantageous to have a layer of elastic material on the inside bore of the choke. Such an elastic material, typical in the form of synthetic rubber, may operate with smaller clearances and still allow for relatively unrestricted movements of the tool joints through the choke. It is foreseeable that the first opening under some conditions will be absent.

A second opening, normally annulus formed, may be present between the choke and the pipe. The width in radial direction of the second opening should preferably be as small as practical possible. A seal may be present between the choke and the pipe, thus closing the second opening.

One end party of the choke may have guides only towards the pipe. This will keep said end party centred in the pipe. The guides may be fixed or biased towards the pipe.

The choke may be positioned axially in the pipe by use of any suitable device such as locking dogs. The locking dogs may be radially movable in the pipe wall and designed to be ROV-operated or activated by use of an actuator.

The pipe may be a marine riser.

A drill fluid return line is connected to the pipe below the choke. The purpose of the fluid return line is explained below.

There is provided a method for control of return flow from a borehole where drill fluid is supplied from a surface rig via a multi section drill string to a bottom hole assembly, the drill pipe sections having tool joints that include an enlarged outer diameter portion, and where an annulus is formed between a pipe and the drill string, and where the annulus is in fluid communication with or forms part of a return path for the drill fluid, and where a choke is positioned in the annulus, and where the method includes extending the length of the choke to exceed the distance between the enlarged outer diameter portions of two adjacent tool joints.

The method may further include:

- connecting a drill fluid return line to the pipe below the choke;
- letting the drill fluid flow through the drill fluid return line; and
- letting the choke restrict flow of gas through the annulus.

In so called single gradient drilling the choke is positioned in the pipe, typically a marine riser, preferably just below the slip joint of the marine riser in order to minimize pressure loss through the drill fluid return line up to a surface rig. If gas is flowing from the well, it is prevented from expanding uncontrolled up to the surface rig. The gas flow may be controlled by a choke valve in the drill fluid return line.

The method may further include connecting a pump to the drill fluid return line.

The method may further include boosting the return flow of drill fluid by use of the pump in order to reduce the bottom hole pressure. In this situation, if some fluid is kept in the pipe above the choke, a downward flow may occur between the choke and the drill pipe, further restricting gas flow passing the choke.

The method may further include regulating the pressure of drill fluid in the pipe by use of the pump. The pressure of drill fluid in the pipe may be regulated dynamically. The pressure may be relatively low during circulation of drill fluid so as to avoid fracture of the well formation. At none-circulating conditions the pressure is changed to a relatively high value in order for the static pressure of the drill fluid to prevent inflow of well fluid to the bore hole. This method for adjusting the Equivalent circulation density (ECD) represents a form of so called dual gradient drilling.

Traditionally the change in pressure has been achieved by varying the fluid level in the pipe in order to vary the fluid pressure exerted on the formation. Such change is, due to large fluid volume in the pipe, relatively slow. Fluid pressure changes may be done more quickly by use of this new method than if the fluid level in the pipe is to be changed in order to vary the pressure exerted on the formation.

Equipment for pressure control receiving information from sensors in and outside the borehole is in itself commonly known and is not explained further here.

The method may further include connecting a boost line to the pipe below the choke. The boost line may be used for supplying fluid to the pump when the drill fluid is not circulated. This feature renders it possible to control and regulate the pressure exerted on the borehole/formation also when the rig-pumps are stopped and there is no flow though the borehole. Such an operation is particularly useful in controlling the so-called surge and swab pressures during tripping RIH (Run in hole)/POOH (Pulling out open hole) and thereby significantly speed up this kind of drilling operation.

The term "boost line" may traditionally be understood to be a line reserved for specific purposes. Here, it should be understood as any line suitable for the purpose.

The method may further include using the boost line for adjustments of the fluid height level in order to vary the fluid pressure exerted on the formation. In this situation there can be no circulation/flow through the "boost line" and it will only contain a static volume of fluid. As the boost line has a much smaller cross-section than the pipe, much less fluid is required to change the fluid height level in the boost line than in the pipe. The change of fluid height may thus be performed much quicker.

The applicant has termed the choke "Riser Isolation Device" (RID) in order to explain at least some of its purpose.

A choke according to the device and method according to the invention significantly help in controlling return drill fluid flow from a bore hole by the use of relatively simple equipment. In particular is the use of complicated seals between the drill pipe and the choke avoided.

Below, an example of a preferred device is explained under reference to the enclosed drawings, where:

Figure 1:
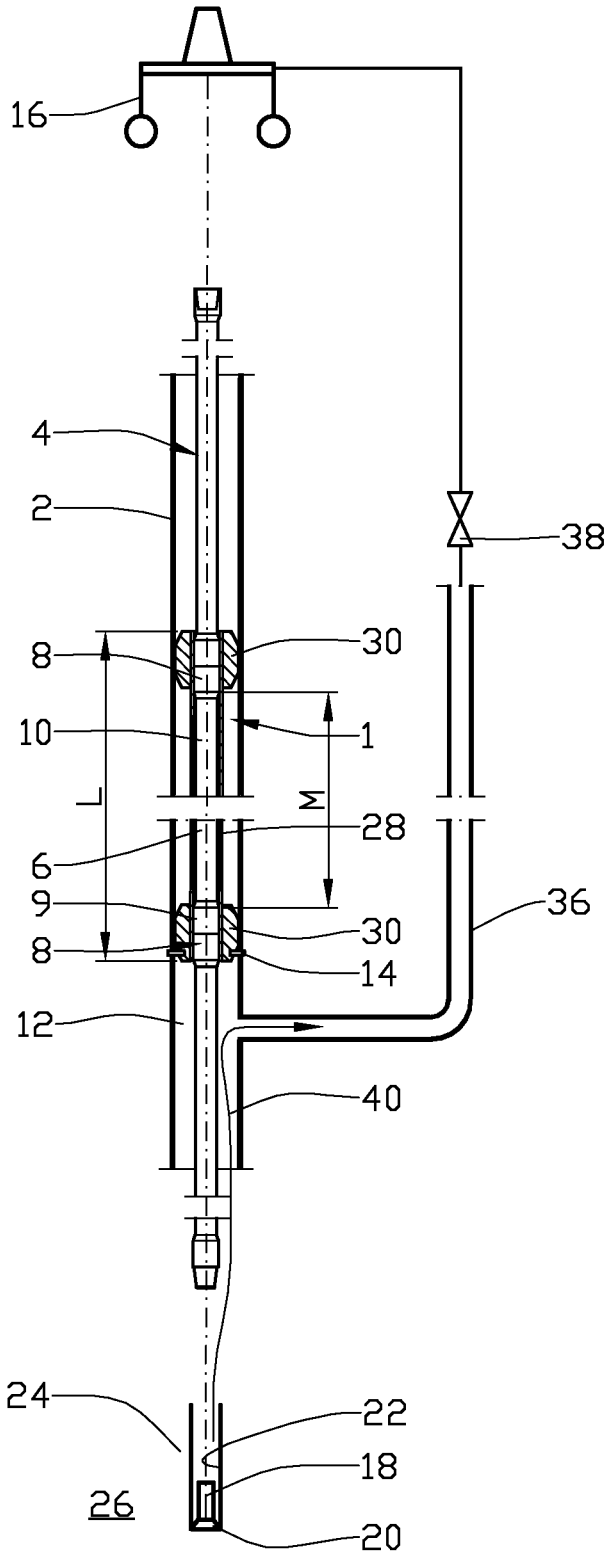
FIG. 1 shows schematic a choke according to the invention positioned in a pipe where a drill fluid return line is connected to the pipe below the choke.
Figure 2:
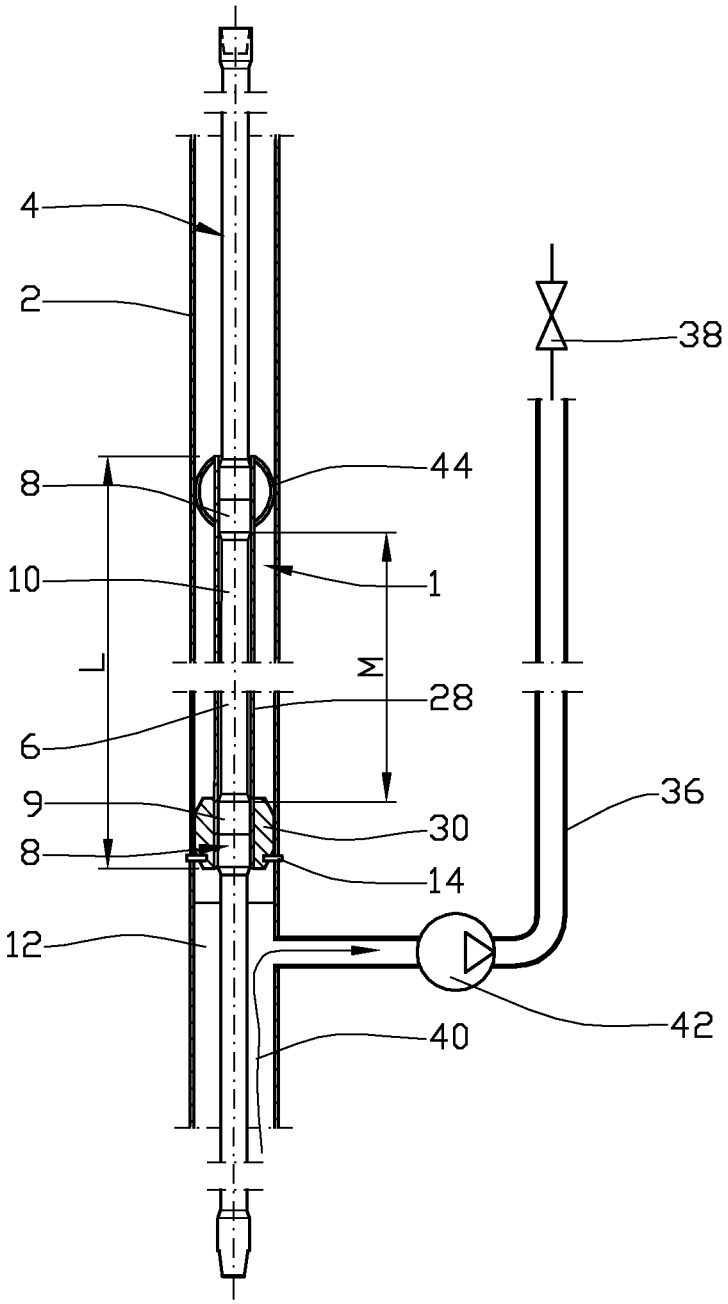
FIG. 2 shows the same as in FIG. 1, but with a pump included in the drill fluid return line.
Figure 3:
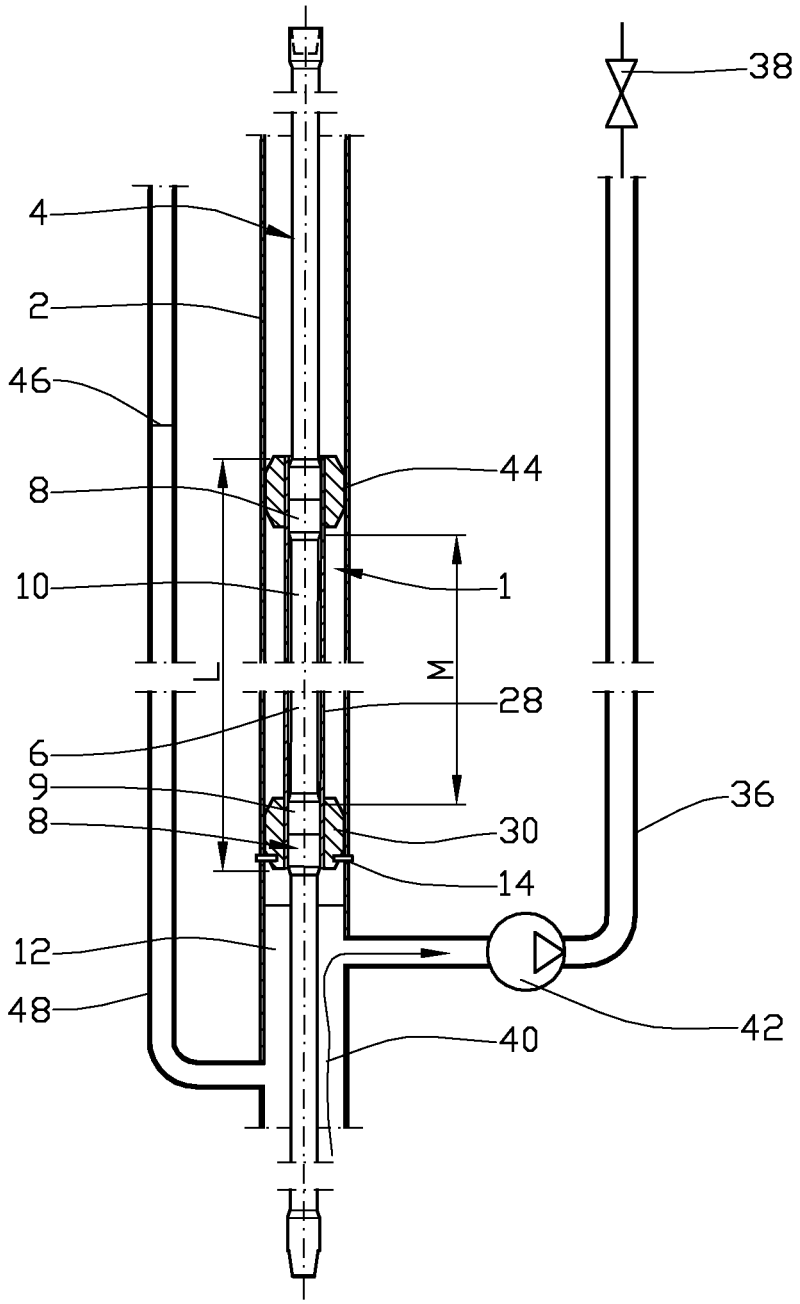
FIG. 3 shows the same as in FIG. 2, but with a boost line connected to the pipe below the choke.

On the drawings the reference number 1 denotes a choke that is positioned in a pipe 2, here in the form of a marine riser. A drill string 4 runs centrally through the choke 1. The drill string 4 is made up of drill pipe sections 6 having tool joints 8. The tool joints 8 have an enlarged outer diameter portion 9 compared to the outer diameter of a portion 10 between the tool joints 8. An annulus 12 is formed between the pipe 2 and the drill string 4. The choke 1 is positioned in the annulus 12 and kept in axial position in the pipe 2 by locking dogs 14.

The drill string 4 runs between a surface rig 16 and a bottom hole assembly 18 that includes a drill bit 20, and is positioned in a borehole 22. The borehole 22 may extend into a formation 24 of a well 26.

In this preferred embodiment the choke 1 includes a cylinder 28 that extends between and is, preferably sealingly, connected to a body 30 at each of its end portions. A length L of the choke 1 exceeds the distance M between the enlarged diameter portions 9 of two adjacent tool joints 8.

Figure 5:
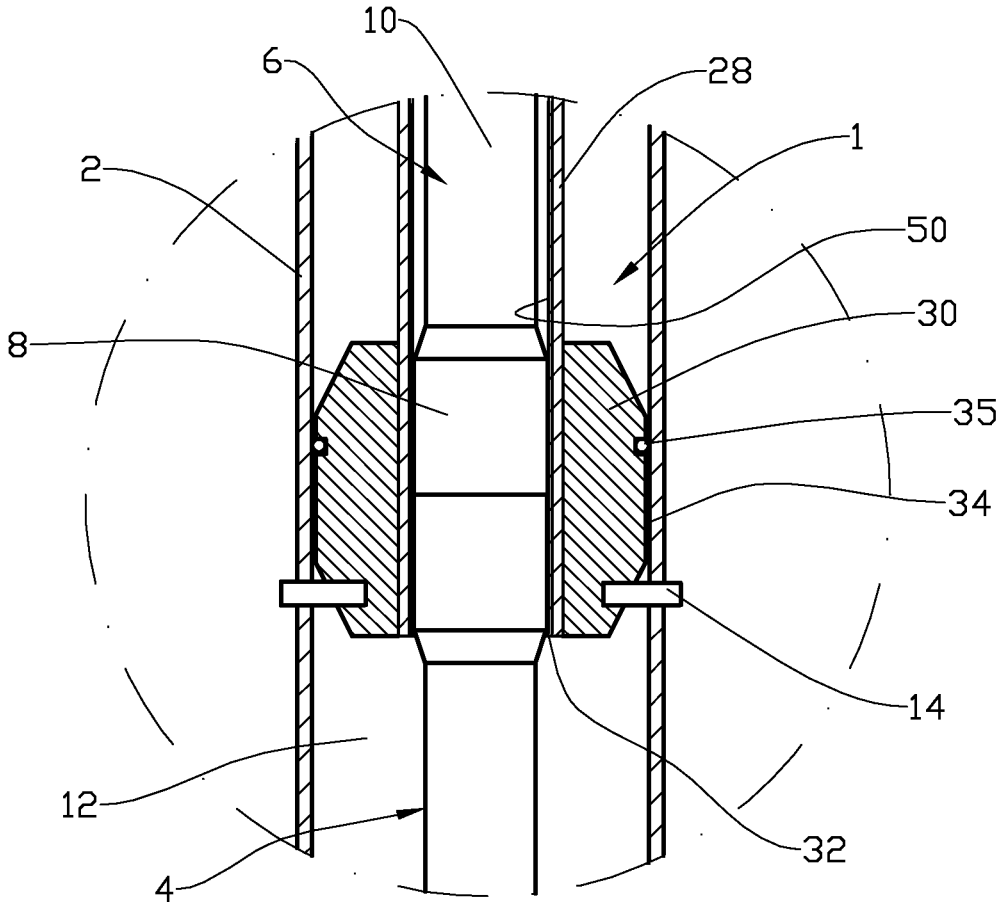
FIG. 5 shows an enlarged part of FIG. 1.

Now referring to FIG. 5, an annular first opening 32 is present between the cylinder 28 of the choke 1 and the tool joint 8. An annular second opening 34 is present between the body 30 and the pipe 2. Depending on the operating conditions a seal 35 may be present in the second opening 34, thus preventing fluid flow through the second opening 34.

As shown in FIG. 1, a drill fluid return line 36 is connected to the pipe 2 at a position below the choke 1 and leads to the surface rig 16. The drill fluid return line is here equipped with a choke valve 38.

When in operation, drill fluid is pumped from the drill rig 16 through the drill string 4 to the drill bit 20 of the bottom hole assembly 18. From the drill bit 20 the drill fluid, that carry with it cuttings, has a drill fluid return path to the drill rig 16 as indicated by the arrow 40. The drill fluid return path 40 includes the borehole 20, a lower part of the pipe 2, the drill fluid return line 36 and the choke valve 38.

As the relative narrow first opening 32 has a substantial choking effect, gas is prevented from expanding uncontrolled up the pipe 2. Any gas flow in the drill fluid return path 40 may be controlled by the choke valve 38.

In a second embodiment, a pump 42 is positioned in the drill fluid return line 36. In this embodiment the upper end portion of the cylinder 28 is shown equipped with a guide 44. The guide 44 is optional.

The pump 42 may be used for boosting the drill fluid return flow in order to reduce the bottom hole pressure. Alternatively the pump 42 may be used for regulating the pressure level of fluid in the pipe 2 as discussed in the general part of this document.

In a third embodiment a fluid level height 46 is kept in a boost line 48 that is connected to the pipe 2 at a position below the choke 1. The boost line 48 communicates with the surface rig 16.

The boost line 48 may be used for supplying fluid to the pump 42 when the drill fluid is stationary i.e. not circulating.

The boost line 48 may be used for relatively quick adjustment of the fluid height level 46. As the choke 1 effectively closes the pipe 2, fluid volumes needed for adjusting the fluid height 46 in the boost line 48, and thereby the pressure in the pipe 2, is comparatively small.

Figure 4:
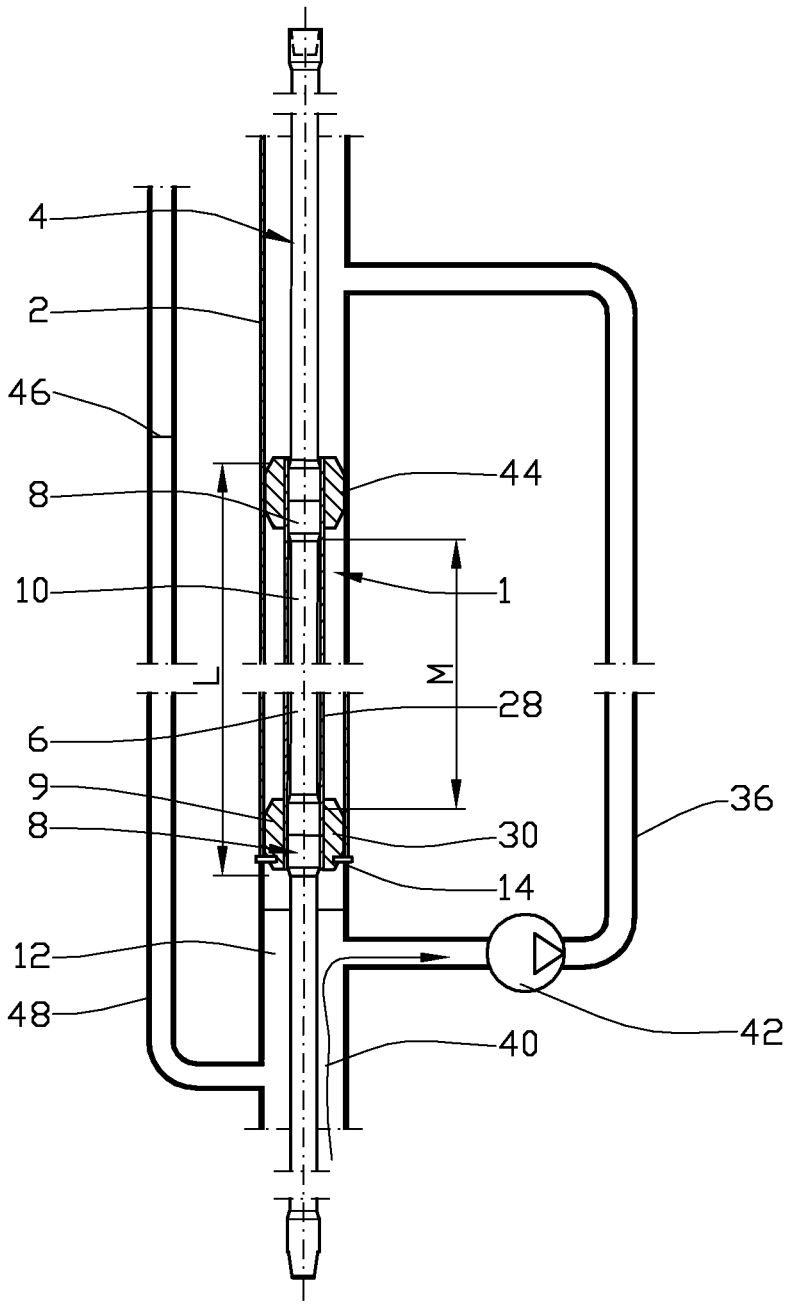
FIG. 4 shows the same as in FIG. 3, but where the drill fluid return line is bypassing the choke.

In FIG. 4 the drill fluid return line 36 is bypassing the choke 1 and connected to the pipe 2 at a height level above the choke 1. The purpose is mainly to save the cost of making a relatively long drill fluid return line 36.

In some cases it may be advantageous to include an elastic material 50 on the inside bore of the cylinder 28, see FIG. 5. The first opening 32 may then be made smaller or be absent without unduly restricting the movement of the drill string 4 in the choke 1.

The invention claimed is:

1. A device for control of return flow from a borehole where drill fluid is supplied from a surface rig via a multi section drill string to a bottom hole assembly, the device comprising:

drill pipe sections having tool joints that include an enlarged outer diameter portion, an annulus formed between a pipe and the drill string, the annulus being in fluid communication with or forming part of a return path for the drill fluid, a choke positioned in the annulus, wherein a length of the choke exceeds a distance between the enlarged outer diameter portions of two adjacent tool joints.

2. The device according to claim 1, wherein a first opening is present between a tool joint and the choke.

3. The device according to claim 2, wherein a width of the first opening is less than 12 mm.

4. The device according to claim 2, wherein a width of the first opening is more than 0.5 mm.

5. The device according to claim 1, wherein the choke is provided with a layer of elastic material on an inside bore of the choke.

6. The device according to claim 1, wherein a second opening is provided between the choke and the pipe.

7. The device according to claim 1, wherein a seal is provided between the choke and the pipe.

8. The device according to claim 1, wherein one end part of the choke is provided with guides extending towards the pipe.

9. The device according to claim 1, wherein the pipe is a marine riser.

10. The device according to claim 1, wherein a drill fluid return line is connected to the pipe below the choke.

11. A method for control of return flow from a borehole comprising the steps of:

supplying drill fluid from a surface rig via a device having a multi section drill string to a bottom hole assembly, the device comprising drill pipe sections having tool joints that include an enlarged outer diameter portion; an annulus formed between a pipe and the drill string, the annulus being in fluid communication with or forming part of a return path for the drill fluid; and a choke positioned in the annulus, and extending a length of the choke to exceed a distance between the enlarged outer diameter portions of two adjacent tool joints.

12. The method according to claim 11, wherein the method further comprises the steps of:

connecting a drill fluid return line to the pipe at a position below the choke;

letting the drill fluid flow through the drill fluid return line; and letting the choke restrict flow of gas through the annulus.

13. The method according to claim 12, wherein the method further comprises the step of:

connecting a pump to the drill fluid return line.

14. The method according to claim 13, wherein the method further comprises the step of:

boosting return flow of the drill fluid by use of the pump.

15. The method according to claim 11, wherein the method further comprises the step of:

connecting a boost line to the pipe at a position below the choke.

16. The method according to claim 15, wherein the method further comprises the step of:

regulating a height level of fluid in the boost line.

17. The method according to claim 13, wherein the method further comprises the step of:

regulating a height level of fluid in a boost line by use of the pump.

18. The method according to claim 13, wherein the method further comprises the step of:

supplying fluid via a boost line to the pump when the drill fluid is stationary.

19. The method according to claim 18, wherein the method further comprises the step of:

regulating pressure in the pipe during run in hole (RIH)/pull out open hole (POOH) operations.

20. The method according to claim 15, wherein the method further comprises the step of:

regulating a height level of fluid in the boost line by use of a pump.

21. The method according to claim 15, wherein the method further comprises the step of:

supplying fluid via the boost line to a pump when the drill fluid is stationary.

* * * * *